US012774565B2

(12) United States Patent
Mascaro et al.

(10) Patent No.: US 12,774,565 B2
(45) Date of Patent: Oct. 27, 2026

(54) METHOD FOR IMPROVING THE BARRIER PROPERTIES OF A PAPER SUBSTRATE

(71) Applicant: LAMBERTI SPA, Albizzate (IT)

(72) Inventors: Andrea Mascaro, Gallarate (IT); Simona Esposito, Gallarate (IT); Marco Ubbiali, Gorla Minore (IT); Thierry Bossi, Azzio (IT); Cristina Barcellona, Legnano (IT)

(73) Assignee: LAMBERTI SPA, Albizzate (IT)

( * ) Notice: Subject to any disclaimer, the term of this patent is extended or adjusted under 35 U.S.C. 154(b) by 162 days.

(21) Appl. No.: 18/712,177

(22) PCT Filed: Dec. 27, 2022

(86) PCT No.: PCT/EP2022/087863
§ 371 (c)(1),
(2) Date: May 21, 2024

(87) PCT Pub. No.: WO2023/126393
PCT Pub. Date: Jul. 6, 2023

(65) Prior Publication Data

US 2025/0019902 A1 Jan. 16, 2025

(30) Foreign Application Priority Data

Dec. 30, 2021 (IT) ..... 102021000033104

(51) Int. Cl.

| | |
|---|---|
| ***D21H 21/16*** | (2006.01) |
| ***D21H 19/12*** | (2006.01) |
| ***D21H 19/22*** | (2006.01) |
| ***D21H 19/54*** | (2006.01) |
| ***D21H 19/58*** | (2006.01) |

(52) U.S. Cl.
CPC ..... *D21H 21/16* (2013.01); *D21H 19/12* (2013.01); *D21H 19/22* (2013.01); *D21H 19/54* (2013.01); *D21H 19/58* (2013.01)

(58) Field of Classification Search
CPC ..... D21H 21/16; D21H 19/12; D21H 19/22; D21H 19/54; D21H 19/58; D21H 27/10; C08F 2/44; C08F 220/1802; C08F 220/1804; C09D 133/08
See application file for complete search history.

(56) References Cited

U.S. PATENT DOCUMENTS

| | | | | |
|---|---|---|---|---|
| 5,358,998 | A | 10/1994 | Wendel et al. | |
| 9,950,502 | B2 | 4/2018 | Seyffer et al. | |
| 10,837,140 | B2 * | 11/2020 | Seyffer | C09D 125/10 |
| 10,837,141 | B2 * | 11/2020 | Seyffer | D21H 19/22 |
| 2010/0236736 | A1 * | 9/2010 | Brockmeyer | C08F 2/44 162/168.1 |
| 2012/0180970 | A1 * | 7/2012 | Song | C08F 2/24 977/773 |
| 2015/0274350 | A1 | 10/2015 | Seyffer et al. | |
| 2018/0135250 | A1 * | 5/2018 | Seyffer | D21H 19/60 |
| 2018/0142416 | A1 * | 5/2018 | Seyffer | D21H 19/12 |
| 2018/0237547 | A1 * | 8/2018 | Veling | D21H 19/54 |
| 2018/0355204 | A1 * | 12/2018 | Turkki | C09D 125/14 |
| 2019/0040169 | A1 * | 2/2019 | Lepo | C08L 3/02 |
| 2020/0062967 | A1 | 2/2020 | Lepo et al. | |
| 2025/0019902 | A1 * | 1/2025 | Mascaro | C08F 220/1802 |

FOREIGN PATENT DOCUMENTS

| | | | | |
|---|---|---|---|---|
| EP | 2788549 | B1 * | 11/2017 | C08F 2/22 |
| EP | 3298195 | B1 * | 7/2019 | C09D 125/10 |
| EP | 2744940 | B1 * | 11/2020 | D21H 19/44 |
| WO | 2017/115009 | A1 | 7/2017 | |
| WO | 2023/126393 | A1 | 6/2023 | |

OTHER PUBLICATIONS

ISR-WO dated Mar. 20, 2023 for parent application PCT/EP2022/087863 (WO2023/126393).

* cited by examiner

*Primary Examiner* — Jose A Fortuna
(74) *Attorney, Agent, or Firm* — Holland & Hart LLP

(57) ABSTRACT

A method for improving the water and/or oil resistance of a paper substrate comprising: i) providing a paper substrate; ii) applying to the paper substrate a water-based barrier coating composition having a solids content from 10 to 55 wt % (% by weight) and comprising from 50 to 95 wt % of an aqueous polymer dispersion having a solids content from 20 to 50 wt % and obtained by emulsion polymerization of: a) from 0 to 40% by weight of at least one ethylenically unsaturated monomer selected among styrene or substituted styrene, b) from 15 to 55% by weight of at least one ethylenically unsaturated monomer selected among $C_1$-$C_{10}$-alkyl (meth)acrylates or cycloalkyl (meth)acrylates, in the absence of ethylenically unsaturated acid monomers and in the presence of c) from 45 to 80% by weight of degraded starch having a molecular weight Mn of 500 to 30,000 Da.

18 Claims, No Drawings

METHOD FOR IMPROVING THE BARRIER PROPERTIES OF A PAPER SUBSTRATE

TECHNICAL FIELD

The present invention relates to a method for coating a paper substrate to provide said paper substrate with improved barrier properties.

BACKGROUND OF THE ART

In the paper and packaging industry, barrier coating compositions are used for improving barrier properties (such as water and/or oil resistance) of paper substrates. Traditionally, barrier coating compositions are based on film-forming polymers derived from fossil resources.

In the recent years there is a growing interest in increasing the bio-based content of barrier coating compositions without adversely affecting the barrier properties of the coated paper substrate. This may be achieved by introducing compounds derived from renewable resources, such as for example polysaccharides or derivatives thereof.

U.S. Pat. No. 9,950,502 relates to paper or a cardboard packaging produced at least partly from mineral oil contaminated paper, wherein the packaging includes at least one barrier layer obtained by applying an aqueous polymer dispersion comprising at least one copolymer obtained by emulsion polymerization of: (a) one or more principal monomers that are $C_1$-$C_4$ alkyl (meth)acrylates, (b) 0.1 to 5 wt % of one or more acid monomers, (c) 0-20 wt % of acrylonitrile and (d) 0 to 10 wt % of a further monomer other than the monomers (a) to (c), wherein a glass transition temperature of the copolymer is in the range from +10 to +45° C. and wherein the emulsion polymerization is carried out in an aqueous medium comprising a carbohydrate compound.

WO 2017/115009 describes a water-based barrier coating composition containing polyvinyl alcohol, a plasticizer, an alkenyl ketene dimer, a gelling agent, a filler and an aqueous polymer obtainable by (co)polymerizing an ethylenically unsaturated monomer blend, optionally in the presence of up to 40% by weight of degraded starch having a molecular weight Mn of 500 to 10,000.

In the paper and packaging industry there is still a need to further increase the bio-based content of barrier coating compositions without adversely affecting the barrier properties of the coated paper substrate.

In the context of the present invention, with the expression "improving the barrier properties" we mean "improving the water and/or oil resistance" of paper substrates. According to the invention, the water resistance is measured according to TAPPI Method T 441, while the oil resistance is measured according to TAPPI Test Method UM 557.

SUMMARY OF THE INVENTION

It is therefore an object of the present invention a method for improving water and/or oil resistance of a paper substrate comprising:

i) providing a paper substrate;

ii) applying to the paper substrate a water-based barrier coating composition having a solids content from 10 to 55 wt % (% by weight) and comprising from 50 to 95 wt % of an aqueous polymer dispersion having a solids content from 20 to 50 wt % and obtained by emulsion polymerization of:

a) from 0 to 40% by weight of at least one ethylenically unsaturated monomer selected among styrene or substituted styrene, b) from 15 to 55% by weight of at least one ethylenically unsaturated monomer selected among $C_1$-$C_{10}$-alkyl (meth)acrylates or cycloalkyl (meth)acrylates, in the absence of ethylenically unsaturated acid monomers and in the presence of c) from 45 to 80% by weight of degraded starch having a molecular weight Mn of 500 to 30,000 Da, wherein the percentage amounts of (a), (b) and (c) are referred to the sum of (a)+(b)+(c).

With the expression "in the absence of ethylenically unsaturated acid monomers", we mean that no ethylenically unsaturated monomer bearing a carboxylic or sulfonic group is employed in the polymerization.

The fact that the aqueous polymer dispersions of the invention are stable is particularly remarkable, as the mere combination of high amounts of polysaccharides (such as starch or derivatives thereof) with synthetic polymers (such as acrylic polymers) usually leads to unstable formulations which tend to separate.

DETAILED DESCRIPTION OF THE INVENTION

Preferably, the method for improving the water and/or oil resistance of a paper substrate comprises:

i) providing a paper substrate;

ii) applying to the paper substrate a water-based barrier coating composition having a solids content from 20 to 45 wt % (% by weight) and comprising from 70 to 90 wt % of an aqueous polymer dispersion having a solids content from 25 to 45 wt % and obtained by emulsion polymerization of:

a) from 0 to 40% by weight of at least one ethylenically unsaturated monomer selected among styrene or substituted styrene, b) from 15 to 55% by weight of at least one ethylenically unsaturated monomer selected among $C_1$-$C_{10}$-alkyl (meth)acrylates or cycloalkyl (meth)acrylates, in the absence of ethylenically unsaturated acid monomers and in the presence of c) from 50 to 70% by weight of degraded starch having a molecular weight Mn of 500 to 20,000 Da, wherein the percentage amounts of (a), (b) and (c) are referred to the sum of (a)+(b)+(c).

According to the invention, the ethylenically unsaturated monomer a) is selected among styrene or substituted styrene. Suitable examples of substituted styrene are α-methylstyrene, ortho-, meta- or para-methylstyrene, ortho-, meta- or para-ethylstyrene, o,p-dimethylstyrene, o,p-diethylstyrene, isopropylstyrene, o-methyl-p-isopropylstyrene, α-butylstyrene, 4-n-butylstyrene or 4-n-decylstyrene. Preferably a) is styrene.

According to the invention, the ethylenically unsaturated monomer b) is selected among $C_1$-$C_{10}$ alkyl (meth)acrylates or cycloalkyl (meth)acrylates.

Suitable $C_1$-$C_{10}$ alkyl (meth)acrylates include methyl methacrylate, methyl acrylate, ethyl acrylate, ethyl methacrylate, propyl acrylate, propyl methacrylate, n-butyl acrylate, n-butyl methacrylate, iso-butyl acrylate, iso-butyl methacrylate tert-butyl acrylate, tert-butyl methacrylate, 2-ethylhexyl methacrylate, 2-ethylhexyl acrylate or mixtures thereof.

Suitable cycloalkyl (meth)acrylates may include, for example, cyclohexyl (meth)acrylate, methyl cyclohexyl (meth)acrylate, dihydrodicyclopentadienyl(meth)acrylate, trimethylcyclohexyl (meth)acrylate, t-butyl cyclohexyl (meth)acrylate or mixtures thereof. Preferred cycloalkyl (meth)acrylates are cyclohexyl methacrylate or cyclohexyl acrylate. Preferably b) is at least one selected among ethyl acrylate, butyl acrylate or cyclohexyl methacrylate.

According to the invention, c) is degraded starch having a molecular weight Mn of 500 to 30,000 Da, preferably from 500 to 20,000 Da. Said degraded starch is obtained from the degradation of natural starch or chemically modified starch. Suitable natural starches include potato, wheat, maize, rice or tapioca starch. Also suitable are chemically modified starches, such as for example hydroxyethyl starch, hydroxypropyl starch or phosphate starch. Degradation of the starches can be effected enzymatically, oxidatively or hydrolytically through action of acids or bases. Degraded starches are commercially available. Said degraded starches can undergo further degradation, for example by treatment with hydrogen peroxide, before or after the polymerization is started.

The average molecular weight of the degraded starch can be determined for example by using gel permeation chromatography, after calibration with pullulan standards.

The ethylenically unsaturated monomers a) and b) are selected so that theoretical glass transition temperature (Tg) of the obtained polymer is more than −30° C. and less than 20° C., preferably more than −30° C. and less than 10° C. The theoretical glass transition temperature (Tg) can be calculated by using the Fox equation (see T. G. Fox, *Bull. Am. Phys. Soc.*, 1, 123 (1956)):

$$\frac{1}{Tg} = \frac{x_1}{Tg_1} + \frac{x_2}{Tg_2} + \dots \frac{x_n}{Tg_n}$$

wherein $x_1$, $x_2$ and $x_n$ are the mass fractions of the different monomers 1, 2, n and $Tg_1$, $Tg_2$, $Tg_n$ represent the actual glass transition temperatures in Kelvin of the corresponding homopolymers. The actual Tg values of the homopolymers are known and listed, for example, in J. Brandrup, E. H. Immergut, *Polymer Handbook,* 4th ed., J. Wiley, New York, 2004.

The polymerization is usually carried out at temperatures of from 30 to 110° C., preferably from 50 to 100° C.

Thermal or redox initiation processes may be used. Conventional free radical initiators may be used such as, for example, hydrogen peroxide, t-butyl hydroperoxide, t-amyl hydroperoxide, alkali or ammonium persulfates, and azo initiators such as 4,4'-azobis(4-cyanopentanoic acid), and 2,2'-azobisisobutyronitrile ("AIBN"), typically at a level of 0.01% to 3.0% by weight, based on the weight of total monomers. Redox systems using the same initiators coupled with a suitable reductant such as, for example, sodium sulfoxylate formaldehyde, sodium hydrosulfite, isoascorbic acid, hydroxylamine sulfate and sodium bisulfite may be used at similar levels, optionally in combination with metal ions such as, for example, iron and copper, optionally further including complexing agents for the metal. Chain transfer agents such as mercaptans may be used to lower the molecular weight of the polymers. Techniques to reduce residual monomers such as, for example, subjecting the reaction mixture to steam stripping, hold times, and additional radical sources may be employed.

The aqueous barrier coating composition of the invention can further contain customary additives in the field of paper coating, such as pigments, thickeners, antiblocking agents, dyes, flow control agents or defoamers.

Suitable pigments include, for example, metal salt pigments such as, for example, calcium sulfate, calcium aluminate sulfate, barium sulfate, magnesium carbonate and calcium carbonate. Calcium carbonate may be natural ground calcium carbonate (GCC), precipitated calcium carbonate (PCC), lime or chalk. Further suitable pigments include, for example, silica, alumina, aluminum hydrate, silicates, titanium dioxide, zinc oxide, kaolin, argillaceous earths, talc or silicon dioxide.

The application of the aqueous barrier coating composition of the invention to the paper substrate can be carried out for example by roller coating, spray coating, curtain coating, blade coating, immersion coating, gravure roll coating, reverse direct gravure coating, rod coating, soft-tip blade coating, jet coating and/or combinations thereof.

The present invention is further illustrated by the following examples.

EXAMPLES

Comparative Example 1

74 g of a dextrin from potato starch (Tackidex® C172Y, commercially available from Roquette) were dispersed with stirring in 240 g of demineralized water in a 1 L glass reactor with a cooling/heating jacket under a nitrogen atmosphere. The dextrin was dissolved by heating the mixture to 85° C.; after dextrin dissolution was completed, 0.02 g of aqueous solution of ferrous (II) sulfate heptahydrate dissolved in small amount of water were added into the reactor. After 15 minutes 3.0 g of 35% strength hydrogen peroxide were added. After 60 minutes, the dextrin degradation was complete. Then the monomers emulsion and initiator feeds were started. 80 g of water, 0.6 g of sodium lauryl sulfate, 130 g of n-butyl acrylate and 70 g of styrene were fed during 120 minutes. 23 g of 12% solution of hydrogen peroxide were fed simultaneously with the monomer feed during 120 min. The reactor temperature was kept at 85° C. during the feeds and 60 minutes after for post-polymerization. Then the mixture was cooled to 40° C. followed by pH adjustment to 8 with diluted ammonium hydroxide solution and cooling to room temperature. Filtration was performed using a 50 μm filter cloth. A finely divided dispersion with a solid content of 41% is obtained.

The theoretical glass transition temperature (Tg) of the polymer, calculated based on the ethylenically unsaturated monomers used, is −17° C.

Example 2

200 g of a dextrin from potato starch (Tackidex® C172Y, commercially available from Roquette) were dispersed with stirring in 390 g of demineralized water in a 1 L glass reactor with a cooling/heating jacket under a nitrogen atmosphere. The dextrin was dissolved by heating the mixture to 85° C.; after dextrin dissolution was completed, 0.05 g of aqueous solution of ferrous (II) sulfate heptahydrate dissolved in small amount of water were added into the reactor. After 15 minutes 8.15 g of 35% strength hydrogen peroxide were added. After 60 minutes, the dextrin degradation was complete. Then the monomers emulsion and initiator feeds were started. 80 g of water, 0.6 g of sodium lauryl sulfate, 130 g of n-butyl acrylate and 70 g of styrene were fed during 120 minutes. 23 g of 12% solution of hydrogen peroxide were fed simultaneously with the monomer feed during 120 min.

The reactor temperature was kept at 85° C. during the feeds and 60 minutes after for post-polymerization. Then the mixture was cooled to 40° C. followed by pH adjustment to 8 with diluted ammonium hydroxide solution and cooling to room temperature. Filtration was performed using a 50 μm filter cloth. A finely divided dispersion with a solid content of 41% is obtained.

The theoretical glass transition temperature (Tg) of the polymer, calculated based on the ethylenically unsaturated monomers used, is −17° C.

Example 3

415 g of a dextrin from potato starch (Tackidex© C172Y, commercially available from Roquette) were dispersed with stirring in 800 g of demineralized water in a 1 L glass reactor with a cooling/heating jacket under a nitrogen atmosphere. The dextrin was dissolved by heating the mixture to 85° C.; after dextrin dissolution was completed, 0.11 g of aqueous solution of ferrous (II) sulfate heptahydrate dissolved in small amount of water were added into the reactor. After 15 minutes 17 g of 35% strength hydrogen peroxide were added. After 60 minutes, the dextrin degradation was complete. Then the monomers emulsion and initiator feeds were started. 80 g of water, 0.6 g of sodium lauryl sulfate, 130 g of n-butyl acrylate and 70 g of styrene were fed during 120 minutes. 23 g of 12% solution of hydrogen peroxide was fed simultaneously with the monomer feed during 120 min. The reactor temperature was kept at 85° C. during the feeds and 60 minutes after for post-polymerization. Then the mixture was cooled to 40° C. followed by pH adjustment to 8 with diluted ammonium hydroxide solution and cooling to room temperature. Filtration was performed using a 50 μm filter cloth. A finely divided dispersion with a solid content of 38% is obtained.

The theoretical glass transition temperature (Tg) of the polymer, calculated based on the ethylenically unsaturated monomers used, is −17° C.

Example 4

200 g of a dextrin from potato starch (Tackidex© C172Y, commercially available from Roquette) were dispersed with stirring in 390 g of demineralized water in a 1 L glass reactor with a cooling/heating jacket under a nitrogen atmosphere. The dextrin was dissolved by heating the mixture to 85° C.; after dextrin dissolution was completed, 0.05 g of aqueous solution of ferrous (II) sulfate heptahydrate dissolved in small amount of water were added into the reactor. After 15 minutes 8.15 g of 35% strength hydrogen peroxide were added. After 60 minutes, the dextrin degradation was complete. Then the monomers emulsion and initiator feeds were started. 80 g of water, 0.6 g of sodium lauryl sulfate, 200 g of ethyl acrylate were fed during 120 minutes. 23 g of 12% solution of hydrogen peroxide was fed simultaneously with the monomer feed during 120 min. The reactor temperature was kept at 85° C. during the feeds and 60 minutes after for post-polymerization. Then the mixture was cooled to 40° C. followed by pH adjustment to 8 with diluted ammonium hydroxide solution and cooling to room temperature. Filtration was performed using a 50 μm filter cloth. A finely divided dispersion with a solid content of 41% is obtained.

The theoretical glass transition temperature (Tg) of the polymer, calculated based on the ethylenically unsaturated monomers used, is −24° C.

Example 5

200 g of a dextrin from potato starch (Tackidex© C172Y, commercially available from Roquette) were dispersed with stirring in 390 g of demineralized water in a 1 L glass reactor with a cooling/heating jacket under a nitrogen atmosphere. The dextrin was dissolved by heating the mixture to 85° C.; after dextrin dissolution was completed, 0.05 g of aqueous solution of ferrous (II) sulfate heptahydrate dissolved in small amount of water were added into the reactor. After 15 minutes 8.15 g of 35% strength hydrogen peroxide were added. After 60 minutes, the dextrin degradation was complete. Then the monomers emulsion and initiator feeds were started. 80 g of water, 0.6 g of sodium lauryl sulfate, 130 g of ethyl acrylate and 70 g of cyclohexyl methacrylate were fed during 120 minutes. 23 g of 12% solution of hydrogen peroxide was fed simultaneously with the monomer feed during 120 min. The reactor temperature was kept at 85° C. during the feeds and 60 minutes after for post-polymerization. Then the mixture was cooled to 40° C. followed by pH adjustment to 8 with diluted ammonium hydroxide solution and cooling to room temperature. Filtration was performed using a 50 μm filter cloth. A finely divided dispersion with a solid content of 41% is obtained.

The theoretical glass transition temperature (Tg) of the polymer, calculated based on the ethylenically unsaturated monomers used, is 8° C.

Applicative Tests

The aqueous polymer dispersions prepared in the previous examples were mixed with an appropriate amount of thickeners to prepare aqueous barrier coating compositions.

The obtained aqueous barrier coating compositions were applied at a coat weight of 5.5 g/m$^2$ on a paper substrate having a grammage of 48 g/m$^2$.

Water resistance and oil resistance of the coated paper substrates were evaluated.

Liquid water resistance was tested using the Cobb method, as described by TAPPI Method T 441. The test time was 600 s. This method determines the amount of liquid water absorbed by paper or paperboard in a specific time under standardized conditions.

Oil absorption capacity was tested using the KIT method, according to TAPPI Test Method UM 557. In this test numbered (from 1 to 16) solutions of increasing hydrophobicity are applied onto the paper substrate. The highest numbered solution that does not stain the surface is reported as result of the KIT test.

Table 1 reports the content of degraded starch (component c)) and the results of the Cobb test and KIT test for each example.

TABLE 1

| Examples | Content of c) (wt %) | Cobb test (g/m$^2$) | KIT test |
|---|---|---|---|
| CE 1* | 25 | 26 | 16 |
| 2 | 50 | 26 | 15 |
| 3 | 65 | 27 | 16 |
| 4 | 50 | 26 | 16 |
| 5 | 50 | 27 | 15 |

*Comparative

The results reported in Table 1 show that increasing the amount of component c) (i.e., degraded starch, which is known for providing coatings with poor water resistance) surprisingly allow to obtain aqueous barrier composition with high oil resistance without adversely affecting the water resistance of the paper substrate.

The invention claimed is:

1. A method for improving water and/or oil resistance of a paper substrate comprising:

i) providing a paper substrate;

ii) applying to the paper substrate a water-based barrier coating composition having a solids content from 10 to 55 wt % (% by weight) and comprising from 50 to 95 wt % of an aqueous polymer dispersion having a solids content from 20 to 50 wt % and obtained by emulsion polymerization of:

a) from 0 to 40% by weight of at least one ethylenically unsaturated monomer selected among styrene or substituted styrene, b) from 15 to 55% by weight of at least one ethylenically unsaturated monomer selected among C1-C10-alkyl (meth)acrylates or cycloalkyl (meth)acrylates, in an absence of ethylenically unsaturated acid monomers and in a presence of c) from 50 to 80% by weight of degraded starch having a molecular weight Mn of 500 to 30,000 Da, wherein percentage amounts of (a), (b) and (c) corresponds to a sum of (a)+ (b)+ (c), and wherein no further degraded starch is added to the aqueous polymer dispersion after the emulsion polymerization.

2. The method for improving the water and/or oil resistance of a paper substrate according to claim 1, wherein the amount of c) is from 50 to 70% by weight.

3. The method for improving the water and/or oil resistance of a paper substrate according to claim 1, wherein the degraded starch has a molecular weight Mn of 500 to 20,000 Da.

4. The method for improving the water and/or oil resistance of a paper substrate according to claim 1, wherein a) is styrene.

5. The method for improving the water and/or oil resistance of a paper substrate according to claim 1, wherein b) is at least one selected among ethyl acrylate, butyl acrylate or cyclohexyl methacrylate.

6. The method for improving the water and/or oil resistance of a paper substrate according to claim 1, wherein the water-based barrier composition comprises from 70 to 90 wt % of the aqueous polymer dispersion.

7. The method for improving the water and/or oil resistance of a paper substrate according to claim 1, wherein the aqueous polymer dispersion has a solids content from 25 to 45 wt %.

8. The method for improving the water and/or oil resistance of a paper substrate according to claim 1, wherein the water-based barrier composition has a solids content from 20 to 45 wt %.

9. The method for improving the water and/or oil resistance of a paper substrate according to claim 1, wherein the water-based barrier composition further contains pigments, thickeners, antiblocking agents, dyes, flow control agents or defoamers.

10. The method for improving the water and/or oil resistance of a paper substrate according to claim 9, wherein the pigments are selected from calcium sulfate, calcium aluminate sulfate, barium sulfate, magnesium carbonate, calcium carbonate, silica, alumina, aluminum hydrate, silicates, titanium dioxide, zinc oxide, kaolin, argillaceous earths, talc or silicon dioxide.

11. The method for improving the water and/or oil resistance of a paper substrate according to claim 1, wherein the ethylenically unsaturated monomers a) and b) are selected so that theoretical glass transition temperature (Tg) of the obtained polymer is more than −30° C. and less than 20° C.

12. The method for improving the water and/or oil resistance of a paper substrate according to claim 1, wherein the ethylenically unsaturated monomers a) and b) are selected so that theoretical glass transition temperature (Tg) of the obtained polymer is more than −30° C. and less than 10° C.

13. The method for improving the water and/or oil resistance of a paper substrate according to claim 1, wherein the degraded starch is obtained from degradation of a natural starch selected from potato, wheat, maize, rice or tapioca starch.

14. The method for improving the water and/or oil resistance of a paper substrate according to claim 1, wherein the degraded starch is obtained from degradation of a chemically modified starch selected from hydroxyethyl starch, hydroxypropyl starch or phosphate starch.

15. The method for improving the water and/or oil resistance of a paper substrate according to claim 1, wherein the degraded starch is obtained by enzymatic, oxidative or hydrolytic degradation of a natural starch or chemically modified starch.

16. The method for improving the water and/or oil resistance of a paper substrate according to claim 1, wherein the emulsion polymerization is carried out at a temperature from 30 to 110° C.

17. The method for improving the water and/or oil resistance of a paper substrate according to claim 16, wherein the emulsion polymerization is carried out at a temperature from 50 to 100° C.

18. The method for improving the water and/or oil resistance of a paper substrate according to claim 1, wherein step ii) is carried out by roller coating, spray coating, curtain coating, blade coating, immersion coating, gravure roll coating, reverse direct gravure coating, rod coating, soft-tip blade coating, jet coating, or a combination thereof.

* * * * *